United States Patent [19]

Ueyama et al.

[11] Patent Number: 4,873,957

[45] Date of Patent: Oct. 17, 1989

[54] THROTTLE VALVE CONTROL APPARATUS

[75] Inventors: Yoshiji Ueyama; Yoshiaki Asayama, both of Himeji, Japan

[73] Assignee: Mitsubishi Denki Kabushiki Kaisha, Tokyo, Japan

[21] Appl. No.: 294,640

[22] PCT Filed: Feb. 17, 1988

[86] PCT No.: PCT/JP88/00160

§ 371 Date: Sep. 27, 1988

§ 102(e) Date: Sep. 27, 1988

[87] PCT Pub. No.: WO88/06681

PCT Pub. Date: Sep. 7, 1988

[30] Foreign Application Priority Data

Feb. 25, 1987 [JP] Japan ..... 62-41850

[51] Int. Cl.[4] ..... F02D 9/02

[52] U.S. Cl. ..... 123/399; 123/400; 123/396; 251/129.03; 251/129.11; 251/248

[58] Field of Search ..... 123/399, 400, 361, 396, 123/395, 403, 376; 251/129.03, 248, 129.11, 129.12, 129.13

[56] References Cited

U.S. PATENT DOCUMENTS

| | | | |
|---|---|---|---|
| 952,398 | 3/1910 | Winton et al. | 251/248 |
| 4,304,202 | 12/1981 | Schofield | 123/376 |
| 4,392,502 | 7/1983 | Weston | 123/342 |
| 4,424,785 | 1/1984 | Ishida et al. | 123/399 |
| 4,430,975 | 2/1984 | Ishida et al. | 123/399 |
| 4,526,060 | 7/1985 | Watanabe | 74/626 |
| 4,727,840 | 3/1988 | Nishida et al. | 123/399 |

FOREIGN PATENT DOCUMENTS

| | | | |
|---|---|---|---|
| 62-75038 | 4/1987 | Japan | 123/399 |

*Primary Examiner*—Andrew M. Dolinar

*Attorney, Agent, or Firm*—Sughrue, Mion, Zinn, Macpeak and Seas

[57] ABSTRACT

A throttle valve control apparatus for opening and closing a throttle valve for a vehicular engine by an electronically controlled actuator is provided, for the purpose of enabling the control of the throttle valve upon the disablement of the electronically controlled actuator, with return springs (5), (14), (19) provided for a valve shaft (3) for the throttle valve (2), a first drive gear (7) interconnected to an accelerator pedal (13), and a second drive gear (8) driven by the electronically controlled actuator (17), respectively.

3 Claims, 1 Drawing Sheet

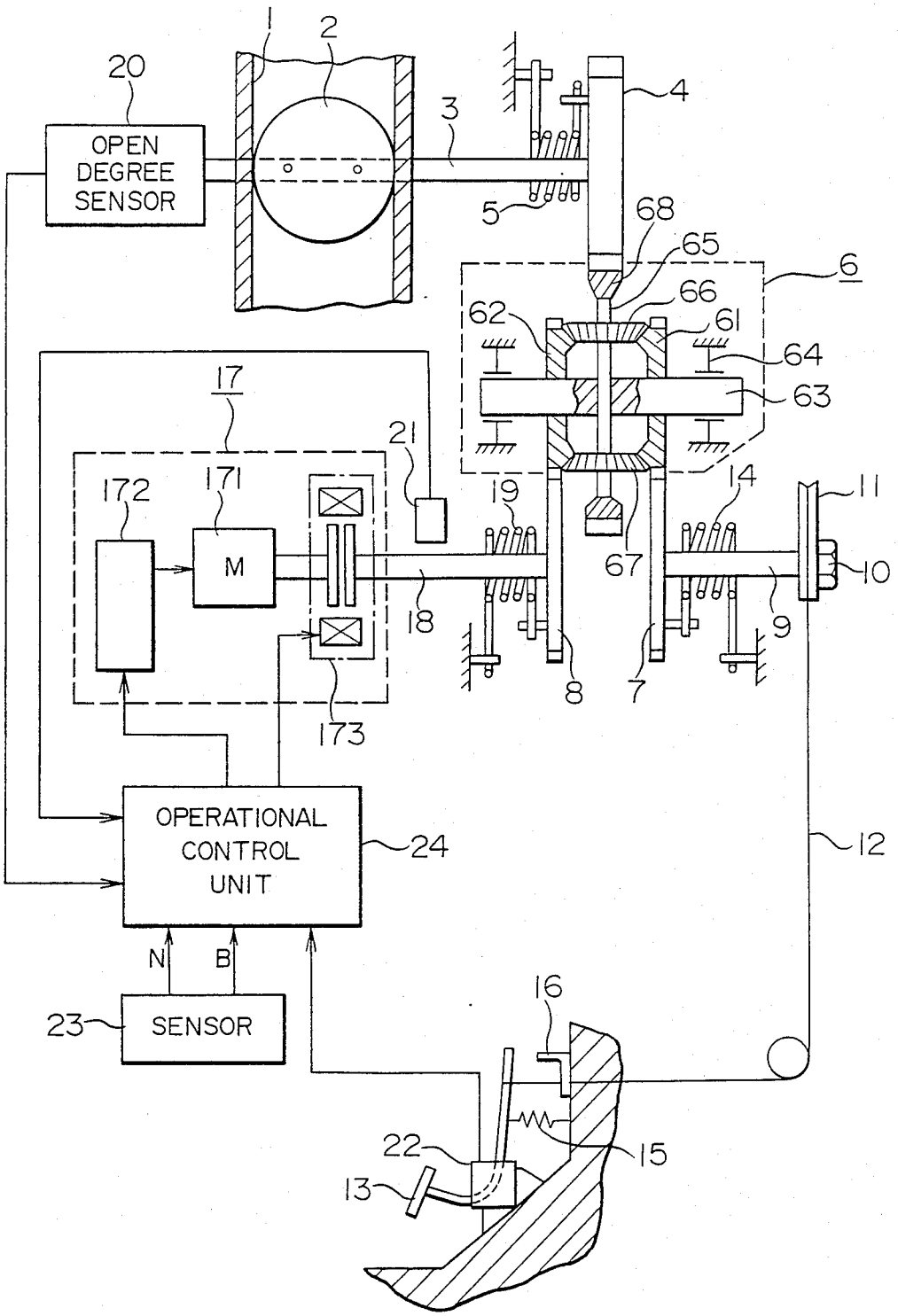
OPEN DEGREE SENSOR
OPERATIONAL CONTROL UNIT
SENSOR
M
N
B
1
2
3
4
5
6
7
8
9
10
11
12
13
14
15
16
17
18
19
20
21
22
23
24
61
62
63
64
65
66
67
68
171
172
173

THROTTLE VALVE CONTROL APPARATUS

TECHNICAL FIELD

This invention relates to a throttle valve control apparatus for opening and closing a throttle valve of a vehicular engine by an electronically controlled actuator.

BACKGROUND ART

Recently, in order to improve the exhaust gas cleaning capability and mileage, a throttle valve control apparatus of the electronically controlled actuator type is being developed in which the mechanical connection between the throttle valve and the accelerator pedal is removed and the throttle valve is controlled to open and close by utilizing a signal representative of an amount of accelerator depression converted into an electrical quantity (accelerator depression amount signal) and a signal representative of engine operating conditions or vehicle running conditions (for example, an engine rpm signal, a gear position signal).

The opening and closing of the throttle valve is achieved by a drive motor which is actuated by a command from a vehicle control apparatus comprising an operation control unit in which an optimum opening degree is successively calculated in response to a signal representative of an engine operation condition or a vehicle travelling condition. Therefore, if an electronically controlled actuator including the above-mentioned drive motor is disabled while the vehicle is moving, the throttle is held open, which may result in the vehicle running out of control and an accident. Therefore, it has been necessary to provide a safety device in which uncontrolled vehicle running can be prevented even when the electronically controlled actuator becomes disabled. Examples in which such a safety device is used are disclosed in Japanese Patent Publication No. 58-25853 and Japanese Patent Laid-Open No. 61-215436. More particularly, in the former, an electromagnetic clutch is provided for disconnecting a throttle valve shaft from the drive motor when the electronically controlled actuator becomes uncontrollable and a return spring is mounted on the throttle valve shaft for completely closing the throttle valve when the electromagnetic clutch is OFF. In the latter, the throttle valve shaft is mechanically rotated through a differential gear unit in accordance with the control amount of the electronically controlled actuator or the amount of accelerator pedal depression.

However, in such a conventional throttle valve control apparatus, while uncontrolled moving of the vehicle can be prevented, the vehicle cannot be driven, posing the problem that the vehicle cannot be moved to a desired position suitable for repair. Also, when only a single return spring is used, the throttle valve cannot be completely closed if this return spring breaks, posing another danger of the vehicle running out of control, and further a strong drive motor having sufficient drive power for overcoming the return spring is necessary when a single powerful spring is used, making the control apparatus larger as the size of the drive motor is increased.

Accordingly, the present invention has been made in order to eliminate such problems of the conventional apparatus and has as its object the provision of a throttle valve control apparatus that is very safe, highly responsive and can be small-sized.

DISCLOSURE OF THE INVENTION

The throttle valve control apparatus of the present invention comprises a valve shaft for opening and closing a throttle valve, a differential gear unit for driving the valve shaft, a first and a second driver gears in mesh with the differential gear unit, and a drive unit for independently driving the above-mentioned drive gears, the arrangement being such that the valve shaft and the first and second drive gears are each provided with a return spring for closing the throttle valve.

According to the present invention, if the second drive gear is disabled to drive, the return spring causes the second drive gear to return to a position corresponding to a throttle valve fully closed position to prevent uncontrolled movement of the vehicle and subsequent driving is achieved by driving the first drive gear. Also, since three return springs are separately mounted, the spring force of each spring is small, so that the drive motor for driving the second drive gear can be made small-sized, and even if one of the return springs breaks the remaining springs can substitute for it, thus maintaining sufficient safety.

BRIEF DESCRIPTION OF THE DRAWINGS

The FIGURE is a schematic diagram of one embodiment of a throttle valve control apparatus of the present invention.

BEST MODE FOR CARRYING OUT THE INVENTION

Description will now be made according to the attached figure for a better understanding of the present invention.

In the figure, 1 is an air intake tube of an engine (not shown), 2 is a throttle valve disposed within the air intake tube 1, 3 is a valve shaft for opening and closing the throttle valve 2, 4 is a gear connected to the valve shaft 3 at its center, 5 is a coil-shaped first return spring through which the valve shaft 3 is inserted and secured at one end to the engine and at the other end at the side portion of the gear 4, which spring 5 applyies a torque in the direction of returning the throttle valve 2 in the closed position to the valve shaft 3 through the gear 4.

Reference numeral 6 is a differential gear unit which comprises bevel gears 61, 62, a shaft 63, a bearing 64, a pinion shaft 65, bevel pinions 66, 67 and a large gear 68. The bevel gears 61, 62 are rotatable with respect to the shaft 63, the shaft 63 is journaled by the bearing 64 and is mounted so that the pinion shaft 65 is perpendicular to the shaft 63. The pinion bevel gears 66, 67 are mounted to the pinion shaft 65 and the pinion bevel gears 66, 67 are in mesh with the bevel gears 61, 62. The opposite ends of the pinion shaft 65 are mounted to the large gear 68 which rotates the valve shaft 3 of the throttle valve 2 through the gear 4.

Reference numerals 7, 8 are first and second drive gears disposed in mesh with the outer peripheries of the bevel gears 61, 62, and 9 is a rotary shaft mounted at the axis of the first drive gear 7, the rotary shaft 9 having mounted thereon a segmented disc 11 secured by the bolts 10, and an accelerator wire 12 connected to the accelerator pedal 13 is wound within the groove of the segmented disc 11. Reference numeral 14 is a coil-shaped second return spring through which the rotary shaft 9 is inserted for providing a tension in the accelerator wire 12, of which one end is connected to the engine and the other end is connected to the side portion of the first drive gear 7, the return spring applying a torque in the direction of returning the throttle valve 2 into the closed position to the first drive gear 7. Reference numeral 15 is a return spring for the accelerator pedal 13, and 16 is a stop for the accelerator pedal 13.

Reference numeral 17 is an electronically controlled actuator which comprises a d.c. drive motor 171, a current control circuit 172 for supplying an electric current to the motor, and an electromagnetic clutch 173. Reference numeral 18 is a rotary shaft mounted at the axis of the second drive gear 8, 19 is a coil-shaped third return spring through which the rotary shaft 18 is inserted and connected at one end to the engine for example and at the other end to the side portion of the second drive gear 8, the third return spring applying a torque in the direction of returning the throttle valve 2 in the closed position to the second drive gear 8. Therefore, when the throttle valve 2 closes, all of the first, the second and the third return springs 5, 14 and 19 act in the direction of closing the throttle valve 2.

While the second drive gear 8 is rotated by the drive motor 171 through the rotary shaft 18, the arrangement is such that since the electromagnetic clutch 173 is disposed between the rotary shaft 18 and the drive motor 171, the rotating force of the drive motor 171 is not transmitted to the rotary shaft 18 when the electromagnetic clutch 173 is deenergized.

Reference numeral 20 is a throttle opening degree sensor for detecting the degree of opening of the throttle valve 2, 21 is a rotating angle sensor for detecting the amount of rotation of the rotary shaft 18 or the second drive gear 8, 22 is an accelerator sensor for detecting the amount of depression of the accelerator pedal 13 operating by the motorist, 23 is a sensor for detecting the operating condition of the engine (rpm N for example) and the operating condition of the vehicle (brake operation B for example). Reference numeral 24 is an operational control unit to which output signals from the throttle opening degree sensor 20, the rotational angle sensor 21, the accelerator sensor 22 and the sensor 23 are supplied and which achieves a predetermined operational processing in correspondence with these input data to drive the drive motor 171 through a current control circuit 172 and to control the coupling condition of the electromagnetic clutch 173.

The operation will now be described. The rotating force of the drive motor 171 is applied to the second drive gear 8 through the electromagnetic clutch 173, and then to the valve shaft 3 through the bevel gear 62, the small bevel gears 66, 67, the pinion shaft 65, the large gear 68 and the gear 4. On the other hand, the drive force is applied to the other bevel gear 61 of the differential gear unit 5 through the accelerator wire 12, the segmented disc 11, the rotary shaft 9 and the first drive gear 7 in accordance with the amount of depression of the accelerator pedal 13.

This rotating drive force of the bevel gear 61 acts upon the small bevel gears 66, 67 to cause the pinion shaft 65 to rotate over an angle equal to half the angle through which the bevel gear 61 rotates in an overlapping relationship with the rotation of the bevel gear 62, the rotating drive force being supplied from the large gear 68 to the valve shaft 3 through the gear 4 in a manner similar to that explained before to open or close the throttle valve 2

When the rotating force is transmitted in the direction in which the throttle valve 2 is opened, the drive force of the drive motor 171 is transmitted to the valve shaft 3 against the third return spring 19, and when the accelerator pedal 13 is depressed the drive force is transmitted to the valve shaft 3 through the differential gear unit 6 and the gear 4 and against the first return spring 5.

When the operator's foot is removed from the accelerator pedal 13 to actuate the brake of the vehicle, while the first drive gear 7 which is driven by the accelerator wire 12 functions in the direction to quickly closing the throttle valve 2 due to the biasing force of the second return spring 14, the second drive gear 8 acts slowly to close the throttle valve 2 due to the delay in following the movement of the drive motor 171. In such case, the braking operation is detected by the sensor 23, the operational control unit 24 to which a detection signal is supplied immediately deenergizes the electromagnetic clutch 173 to OFF, so that the electronically controlled actuator 17 and the second drive gear 8 are separated. As a result, the second drive gear 8 is quickly return to a position corresponding to the position in which the throttle valve 2 is fully open due to the return force of the third return spring 19 acting upon it. Of course, when the throttle valve 2 is to be returned to the fully closed position, the biasing force of the first return spring 5 also acts upon the gear 4 so that it is utilized as an auxiliary force.

This kind of operation can be realised by turning OFF the power source for the drive motor 171 when the electromagnetic clutch 173 is turned ON and idle-rotating the drive motor 171 by the biasing force of the third return spring 19.

Also, if the drive motor 171 or the current control circuit 172 is disabled, the rotating motion of the second drive gear 8 become abnormal. The rotational angle sensor 21 detects this abnormality to supply an abnormal rotational angle detection signal to the operational control unit 24, which upon detection immediately turns OFF the electromagnetic clutch 173, returning the second drive gear 8 to the position corresponding to the fully closed position of the throttle valve 2 by the action of the third return spring 19, thereby preventing the uncontrolled running of the vehicle. After turning OFF the electromagnetic clutch 173, only the first drive gear 7 is directly driven by the accelerator pedal 13 through the accelerator wire 12 to achieve the driving of the vehicle.

Further, if it is difficult for the throttle valve 2 to be fully closed by the biasing forces of the first, the second and the third return springs 5, 14 and 19 due to for example freezing, the electronically controlled actuator 17 reversely drives the second drive gear 7 in the direction in which the throttle valve 2 fully closes to increase the closing force on the throttle valve 2 by the drive motor 171 in order to cope with the freezing, etc. As has been explained, the spring forces of the first and the third return springs 5 and 19 which act against the throttle valve 2 being opened by the drive motor 171 do not have to be strong enough to overcome freezing, so that these spring forces can be small, enabling the drive motor 171 to be small in size and power.

Also, even if one of the first, the second or the third return springs 5, 14 and 19 is broken, the action of the remaining springs can fully close the throttle valve 2.

As has been described, according to the present invention, each of the return springs is arranged to move the first and the third drive gears in the direction in which the throttle valve is closed, so that the responsiveness of the apparatus is improved and even when the electronically controlled actuator is disabled the vehicle is controllable and drivable, improving safety. Also, since the return springs are distributed, chattering due to backlash of the gears can be prevented and even when one of the springs is broken the remaining ones can fully close the throttle valve, increasing the safety, and moreover since the drive motor is not required to have a drive force that overcomes the total spring forces of the return springs, the drive motor can be made compact, contributing to the decrease in size of the apparatus.

We claim:

1. A throttle valve control apparatus comprising a valve shaft for opening and closing a throttle valve for changing the engine output, a differential gear unit for driving said valve shaft, a first and a second drive gear in mesh with said differential gear unit, and a first and a second drive means for independently driving said drive gears, characterized in that said valve shaft and said first and second drive gears are each provided with a return spring acting in a direction in which said throttle valve is closed.

2. A throttle valve control apparatus as claimed in claim 1, wherein when said throttle valve is to be closed, said second drive means reversely drives said second drive gear in the direction in which said throttle valve is fully closed.

3. A throttle valve control apparatus as claimed in claim 1, wherein said first drive means comprises a mechanical means connected to an accelerator pedal through an accelerator wire, and said second drive means comprises an electrical means including an operational processing unit which receives output signals from a plurality of sensors detecting the operating condition of the engine for achieving a predetermined operational processing, and an electric motor and an electromagnetic clutch for driving said second drive gear in accordance with an output signal from said operational processing unit.

* * * * *